US006214392B1

(12) United States Patent
Ramirez

(10) Patent No.: US 6,214,392 B1
(45) Date of Patent: Apr. 10, 2001

(54) PACKAGING ARTICLE WITH OFFSET VENTED SEAL

(75) Inventor: Joseph M Ramirez, Greer, SC (US)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 09/268,458

(22) Filed: Mar. 16, 1999

(51) Int. Cl.[7] ..... B65D 85/00

(52) U.S. Cl. ..... 426/106; 426/118; 426/805; 383/100

(58) Field of Search ..... 426/106, 118, 426/127, 805, 395; 383/100, 103, 120

(56) References Cited

U.S. PATENT DOCUMENTS

| | | | | |
|---|---|---|---|---|
| 3,092,249 | * | 6/1963 | Chapman | 206/210 |
| 3,237,844 | * | 3/1966 | Hughs | 383/94 |
| 3,302,859 | * | 2/1967 | Perry | 383/103 |
| 3,637,132 | * | 1/1972 | Gray | 229/53 |
| 3,750,937 | * | 8/1973 | Goodwin | 229/66 |
| 3,937,395 | * | 2/1976 | Lawes | 229/62.5 |
| 4,057,144 | * | 11/1977 | Schuster | 206/439 |
| 4,064,296 | | 12/1977 | Bornstein et al. | 428/35 |
| 4,470,153 | * | 9/1984 | Kenan | 383/100 |
| 4,581,764 | | 4/1986 | Plock et al. | 383/101 |
| 4,863,768 | * | 9/1989 | Ishio et al. | 428/34.9 |
| 4,863,784 | * | 9/1989 | Lustig et al. | 428/218 |
| 5,069,946 | * | 12/1991 | Moritani et al. | 428/36.6 |
| 5,558,441 | * | 9/1996 | Morrison et al. | 383/87 |

FOREIGN PATENT DOCUMENTS

| | | | |
|---|---|---|---|
| 9714943A | * | 9/1997 | (AU) . |
| 9156650 | | 6/1977 | (JP) . |

OTHER PUBLICATIONS

1990 Annual Book of ASTM Standards, vol. 08.02, pp. 368–371.

* cited by examiner

*Primary Examiner*—Keith Hendricks
*Assistant Examiner*—Sherry A. Dauerman
(74) *Attorney, Agent, or Firm*—Rupert B. Hurley, Jr.

(57) ABSTRACT

A packaged product comprises a packaging article and a product surrounded by the packaging article. The packaging article comprises a flexible packaging film. The packaging article has a seal along one edge thereof, the seal comprising two seals each having a gap therein, i.e., a vent, which allows air within the package to escape during stacking of the bags on, for example, a pallet. The vents also allow air to reenter the bag so that the bags maintain a uniform appearance for display and sale. The vents are offset from one another, to provide a tortuous path into and out of the packaging article, to minimize the escape of the product and the entry of foreign objects.

27 Claims, 5 Drawing Sheets

PACKAGING ARTICLE WITH OFFSET VENTED SEAL

FIELD OF THE INVENTION

The present invention relates to an article comprising a multilayer film suitable for packaging end use, especially a multilayer film suitable for use in the packaging of relatively hard, granular bulk products, such as dry pet food. The article comprises a heat seal of the film to itself or another film, preferably, in the form of a gusseted bag. The present invention also relates to packaged products in which the package comprises the article of the invention.

BACKGROUND OF THE INVENTION

In the packaging of granular bulk products, such as dry pet food, it has been found that if such products are packaged in a sealed plastic bag, the bags, when stacked on a pallet, tend to either burst or topple over. The air inside the package causes the bag to appear to be inflated, i.e., "balloon," as it is placed under increasing pressure. The ballooning is the result of pressurization within the bag, as the bag is flattened to a point at which the atmosphere sealed therewithin is placed under pressure. The result is that the pressure within the bags causes bags to burst, or causes the stack to topple, or both.

Typically, the bags contain relatively large amounts of packaged product, e.g., from 5 to 20 or more kilograms of granular product. It would be desirable to provide a means for packaging bulk granular product in plastic bags, with the packaged product being stackable without causing the bags to burst or topple over.

SUMMARY OF THE INVENTION

It has been discovered that the packaging of stackable, palletizable bulk product in plastic bags can be carried out if the plastic bag is provided with a vent. The vent allows air to pass out of the plastic bag as the pressure increases from stacking. As a result, the bag is not pressurized, and does not tend to burst or topple. Moreover, if the vent also allows air to enter the bag, the appearance of the bags will remain uniform even though the bags have been subjected to varying pressure during storage and shipment, as a function of the position of the bag in a stack of bags. Allowing air to return into the bag provides the bags with a uniform appearance when displayed for sale.

However, there is the possibility that the vent will allow the bulk product to escape from the bag, as well as the possibility that foreign objects can enter the package through the vent. The escape of bulk product, and the entry of foreign objects, is reduced by providing the bag with a pair of seals each of which has a vent therein, with the vents being offset from one another. The offset vents result in a tortuous path into and out of the plastic bag. As a result, the escape of the bulk product, and the entry of foreign objects, is reduced or eliminated.

As a first aspect, the present invention is directed to a packaged product comprising a packaging article comprising a non-perforated flexible packaging film and a product surrounded by the packaging article. The packaging article comprises a first seal paired with a second seal, with both the first and second seals being of the film to at least one member selected from the group consisting of itself and another film. A discontinuity (i.e., gap) in the first seal provides a first vent, and a discontinuity in the second seal provides a second vent. The first vent is offset from the second vent.

Preferably, the first seal is a heat seal and the second seal is a heat seal.

Preferably, the first vent has a length of from about ⅛ inch to 3 inches, and the second vent has a length of from about ⅛ inch to 3 inches; more preferably from about ¼ to about 2 inches; still more preferably, from about ½ inch to about 1½ inches.

Preferably, the first vent is offset from the second vent by a distance of at least about 1 inch; more preferably, from about 1 inch to about 50 inches; more preferably, from about 1 inch to about 30 inches; more preferably, from about 1 inch to about 20 inches; more preferably, from about 1 inch to about 15 inches; more preferably, from about 3 inches to about 15 inches; more preferably, from about 5 inches to about 15 inches. As used herein, the term "offset" is a distance determined measuring from the inside end of one vent to the inside end of the other vent. Offset vents do not overlap one another, to provide a tortuous path into and out of the package.

Preferably, paired seals are separated by a distance of from about ½ inch to about 4 inches; more preferably, from about ¾ inch to about 2 inches; more preferably, from about 1 inch to 1½ inches. Preferably, the paired seals are linear and parallel to one another. Alternatively, they can be curved seals, which also are preferably parallel to one another.

Preferably, the product has a weight of at least about 5 kilograms; more preferably, at least about 10 kilograms; more preferably, at least about 12 kilograms; more preferably, at least about 16 kilograms; more preferably, at least about 20 kilograms. Preferably, the product has a weight of no more than about 50 kilograms.

Preferably, the product comprises granular, dry edible particulates. Preferably, the granular, dry edible particulates comprise at least one member selected from the group consisting of livestock feed, sugar, coffee, cookies, cereal, cake mix, crackers, chips, powdered milk, charcoal, cement, fertilizer, lime, pesticide, herbicide, and plant food. More preferably, the product comprise granular, dry pet food.

Preferably, the packaging article is a member selected from the group consisting of an end-seal bag and a side-seal bag. In one preferred embodiment, the packaging article comprises side gussets, and preferably further comprises a longitudinal lap seal. In another preferred embodiment, the packaging article comprises a bottom gusset, and preferably further comprises a first side seal and a second side seal.

Preferably, the first seal is a seal of the film to itself, and the second seal is a seal of the film to itself. Preferably, the first seal is a seal of an inside layer of the film to itself, and the second seal is a seal of the inside layer of the film to itself.

Preferably, packaging article comprises a multilayer film having: (A) a first film layer which is an inside film layer comprising at least one member selected from the group consisting of ethylene/alpha-olefin copolymer and polystyrene; (B) a second film layer comprising at least one member selected from the group consisting of ethylene/unsaturated ester copolymer, anhydride-modified ethylene/alpha-olefin copolymer, anhydride-modified ethylene/ester copolymer, acid-modified ethylene/alpha-olefin copolymer, acid-modified ethylene/acid copolymer, and polystyrene; (C) a third film layer comprising at least one member selected from the group consisting of ethylene/alpha-olefin copolymer and polystyrene; (D) a fourth film layer which comprises at least one member selected from the group consisting of ethylene homopolymer, ethylene/alpha-olefin copolymer, ethylene/vinyl alcohol copolymer, polyvinylidene chloride, polyamide, polyester, polyalkylene carbonate, polyacrylonitrile, and ethylene/unsaturated ester copolymer.

Preferably, at least 85 percent of the film, based on total film volume, consists of at least on member selected from the group consisting of polyolefin homopolymer, polyolefin copolymer, ethylene/ester copolymer, polystyrene, styrene/butadiene copolymer, EVOH, PVDC, and polyacrylonitirile (more preferably, from about 87 to about 100; still more preferably from about 89 to about 100; yet still more preferably, from about 90 to about 100; even yet still more preferably, from about 92 to about 100; and even still more preferably, from about 95 to about 100 volume percent).

Preferably, the film has a total thickness of at least 2 mils, and an impact strength of at least about 1.5 ft-lbs (preferably, at least 1.6 ft-lbs; more preferably, at least 1.7 ft-lbs). Preferably, the film has an impact strength of from about 1.5 to about 20 ft-lb; more preferably, from about 2 to about 5 ft-lb. Preferably, the film has a ball burst impact strength of from about 10 to about 70 cm-kg; more preferably from about 20 to about 60 cm-kg; still more preferably, from about 30 to about 50 cm-kg.

Preferably, the film has a total free shrink (i.e., L+T), at 180° F., of less than 80 percent (preferably, 1 to 75 percent, more preferably 1 to 50 percent, more preferably 5 to 40 percent, and more preferably 20 to 30 percent).

Preferably, the film comprises an $O_2$-barrier layer comprising at least one member selected from the group consisting of ethylene/vinyl alcohol copolymer, polyvinylidene chloride, and polyamide.

In the multilayer film, preferably the second layer is between the first layer and the third layer, and the third layer is between the second layer and the fourth layer. Preferably, the (a) the first film layer is directly adhered to the second film layer;(b) the third film layer is directly adhered to the second film layer; (c) the third film layer is between the second film layer and the fourth film layer; and (d) the film further comprises an adhesive between the third film layer and the fourth film layer.

Preferably, the packaging article comprises a heat seal of the first film layer to itself. Preferably, the seal is a seal of an inside layer of the film to itself.

Preferably, the first and third film layers further comprise ethylene/unsaturated ester copolymer.

Preferably, the first film layer comprises oriented polymer, the second film layer comprises oriented polymer, and the third film layer comprises oriented polymer, with the multilayer film having a tensile strength at break of at least 4000 psi; more preferably, from about 4000 to 50,000 psi; still more preferably, from about 4500 to 35,000 psi; yet still more preferably, from about 5,000 to 25,000 psi.; even yet still more preferably, from about 4,000 to 14,000 psi. Preferably, each of the first, second, and third film layers are biaxially oriented to a total orientation (i.e., L+T) in an amount of from about 50 to 500 percent at a temperature of from about 180 to 300° F.; more preferably, in an amount of from about 150 to 250 percent. Preferably, the fourth film layer also comprises oriented polymer, and preferably each of the oriented polymers is biaxially oriented to a total orientation of from about 200 to 500% at a temperature of from about 200 to 280° F.; still more preferably, each of the oriented polymers is biaxially oriented to a total orientation of from about 150 to 250 percent, at a temperature of from about 210 to 270° F.

Preferably, the multilayer film comprises a crosslinked polymer network. Preferably, the crosslinked polymer network is produced by irradiation, preferably irradiation at a level of from about 0.5 to 15 MR (i.e., 5 to 150 kGy); more preferably, from about 1 to 8 MR (i.e., 10–80 kGy); still more preferably, from about 3 to 5 MR (i.e., 30–50 kGy).

Preferably, the multilayer film has a tear propagation of from about 50 to 800 grams; more preferably, from about 60 to 700 grams; still more preferably, from about 100 to 600 grams. Alternatively, the multilayer film has a tear propagation of from about 10 to 500 grams per mil; more preferably, from about 15 to 200 grams per mil.

Preferably, the fourth film layer comprises at least one member selected from the group consisting of ethylene/alpha-olefin copolymer and ethylene/unsaturated ester copolymer. Preferably, the fourth film layer comprises high density polyethylene. Preferably, the film further comprises a fifth film layer which serves as an $O_2$-barrier layer, the fifth film layer being between the third film layer and the fourth film layer, the fifth film layer comprising at least one member selected from the group consisting of PVDC, EVOH, polyalkylene carbonate, polyacrylonitrile, polyamide, and polyester.

Preferably, the multilayer film further comprises: (a) a sixth film layer which is between the fourth film layer and the fifth film layer, the sixth film layer serving as a first tie layer and comprising at least one member selected from the group consisting of ethylene/unsaturated ester copolymer, anhydride-modified ethylene/alpha-olefin copolymer, anhydride-modified ethylene/ester copolymer, acid-modified ethylene/alpha-olefin copolymer, and acid-modified ethylene/acid copolymer; and (b) a seventh film layer which is between the third film layer and the fifth film layer, the seventh film layer serving as a second tie layer and comprising at least one member selected from the group consisting of ethylene/unsaturated ester copolymer, anhydride-modified ethylene/ alpha-olefin copolymer, anhydride-modified ethylene/ester copolymer, acid-modified ethylene/alpha-olefin copolymer, and acid-modified ethylene/acid copolymer. Preferably, the film further comprises an eighth film layer which is between the third film layer and the seventh film layer, the eighth film layer comprising at least one member selected from the group consisting of ethylene/alpha-olefin copolymer and ethylene/unsaturated ester copolymer. Preferably, the film further comprises a ninth film layer which comprises a laminating adhesive. Preferably, the laminating adhesive comprises a urethane-based adhesive.

Preferably, the multilayer film has an outside surface having a gloss of at least 60 percent; preferably, from about 60 to 100 percent; more preferably, from about 80 to 90 percent.

Preferably, the multilayer film has a modulus of at least about 30,000 psi. Preferably, at least one member selected from the group consisting of the first layer and the second layer comprise polystyrene, with the multilayer film having a modulus of at least about 20,000 psi.; more preferably, from about 25,000 to 300,000 psi; still more preferably, from about 30,000 to 200,000 psi.

Preferably, at least one layer of the multilayer film has pigment therein or thereon. In one preferred embodiment, trap printing is present between the third layer and the fourth layer. In another, printing is present on an outside surface of the second outer layer of the multilayer film.

In an alternative preferred embodiment, at least one member selected from the group consisting of the first layer and the second layer comprises polystyrene, and wherein the multilayer film has a modulus of at least about 20,000 psi.

An alternative but preferred multilayer film for use in the packaged product of the present invention comprises at least 6 layers. The first film layer is an inside film layer comprising at least one member selected from the group consisting of ethylene/alpha-olefin copolymer and polystyrene; the second film layer serves as tie layer, and comprises at least one member selected from the group consisting of ethylene/unsaturated ester copolymer, anhydride-modified ethylene/alpha-olefin copolymer, anhydride-modified ethylene/ester copolymer, acid-modified ethylene/alpha-olefin copolymer, acid-modified ethylene/acid copolymer; the third film layer comprising at least one member selected from the group consisting of polyvinylidene chloride, ethylene/vinyl alcohol copolymer, polyalkylene carbonate, and polyacrylonitrile; the fourth film layer which serves as tie layer, and which comprises at least one member selected from the group consisting of ethylene/unsaturated ester copolymer, anhydride-modified ethylene/alpha-olefin copolymer, anhydride-modified ethylene/ester copolymer, acid-modified ethylene/alpha-olefin copolymer, acid-modified ethylene/acid copolymer; the fifth film layer comprises at least one member selected from the group consisting of ethylene/alpha-olefin copolymer and polystyrene; the sixth film layer comprises at least one member selected from the group consisting of high density ethylene homopolymer, ethylene/alpha-olefin copolymer, propylene homopolymer, propylene homopolymer, polystyrene, styrene/butadiene copolymer, polystyrene, propylene. At least 85 percent of the multilayer film, based on total film volume, is made of (i.e., consists of) at least on member selected from the group consisting of polyolefin homopolymer, polyolefin copolymer, ethylene/ester copolymer, polystyrene, styrene/butadiene copolymer, EVOH, PVDC, and polyacrylonitirile, more preferably, from about 87 to 100 percent; still more preferably 89–100 percent; yet still more preferably, from about 90–100 percent; even yet still more preferably, from about 92–100 percent; and even still more preferably, from about 95–100 percent. The film has a total thickness of at least 2 mils, and a tear propagation of at least 300 grams. Preferably, the packaging article comprises a heat seal of the film to at least one member selected from the group consisting of itself and another film. Preferably, the multilayer film has a tear propagation of from about 300 to 800 grams; more preferably, from about 350 to 700 grams; still more preferably, from about 400 to 600 grams; and, yet still more preferably, from about 500 to 600 grams. Preferably, the multilayer film has a modulus of at least about 30,000 psi.; more preferably, from about 30,000 to 250,000 grams.

As a second aspect, the present invention is directed to a method of making a packaged product. The method comprises: (A) converting a flexible packaging film to a bag having a closed bottom, closed sides, and an open top; (B) filling the bag with a bulk granular product; and, (C) sealing across the top of the bag with a first seal and a second seal. A discontinuity in the first seal provides a first vent. A discontinuity in the second seal provides a second vent. The first vent is offset from the second vent. Preferably, the process is carried out to make a preferred packaged product in accordance with the first aspect of the present invention. For example, preferably the first seal is a heat seal and the second seal is a heat seal. Preferably, an impulse heat sealing process is used to make both the first heat seal and the second heat seal.

DETAILED DESCRIPTION OF THE INVENTION

Figure 1:
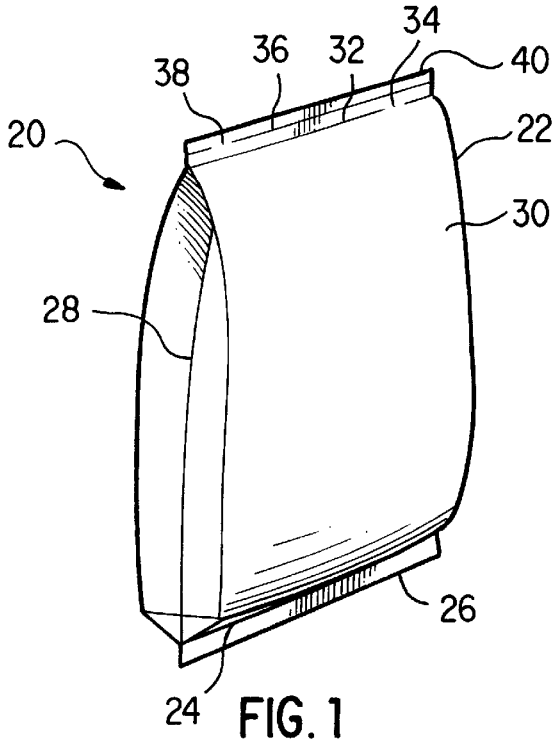
FIG. 1 illustrates a perspective view of a packaged product in accordance with the present invention, utilizing a side gusseted bag.

Preferred films for use in the packaged product and process of the present invention are disclosed in U.S. Ser. No. 08/970,187, to Parimal M. Vadhar, entitled "Packaging Article," which is hereby incorporated, in its entirety, by reference thereto.

As used herein, the phrase "packaging article" is used with reference to bags, pouches, casings, etc. which are useful for the packaging of products.

As used herein, the term "film" is used in a generic sense to include plastic web, regardless of whether it is film or sheet. Preferably, films of and used in the present invention have a thickness of 0.25 mm or less. As used herein, the term "package" refers to packaging materials configured around a product being packaged. The phrase "packaged product," as used herein, refers to the combination of a product which is surrounded by a packaging material.

As used herein, the term "seal" refers to any seal of a first region of an outer film surface to a second region of an outer film surface, including heat or any type of adhesive material, thermal or otherwise. Preferably, the seal is formed by heating the regions to at least their respective seal initiation temperatures. The sealing can be performed by any one or more of a wide variety of manners, such as using a heat seal technique (e.g., melt-bead sealing, thermal sealing, impulse sealing, dielectric sealing, radio frequency sealing, ultrasonic sealing, hot air, hot wire, infrared radiation, etc.).

A preferred sealing method is impulse heat sealing utilizing seal wire of a material known as Toss Alloy 20, obtained from Toss Machine Components of Nazareth, Pa. The seal wire was 6 millimeters wide and 0.15 millimeters thick, presenting a flat surface to the film, but having tapered edges. In making the seal, the total dwell time is about 2 seconds, with the pressure being about 500 pounds across each of the approximately 23 inch long sealing length.

As used herein, the phrase "paired seals" refers to two or more seals which are positioned close to one another along an edge of a bag, pouch, casing, etc. For example, an end-seal bag, full of relatively hard, granular bulk products, such as dry pet food, can be made by first forming a side-gusseted bag, and thereafter applying a bottom heat seal to the bag, filling the bag with product, and thereafter heat sealing across the top of the filled bag. If the top is sealed with paired heat seals, the paired heat seals could for example each be linear, parallel, heat seals separated by a distance of about 1¼ inch. Such seals are "paired" seals, regardless of the perpendicular distance between them, so long as the product in the bag (i.e., chamber) is between the bottom seal and the more inward of the paired top seals.

As used herein, the term "vent" refers to a discontinuity (i.e., break or gap) in a seal which allows atmosphere from within the package (i.e., atmosphere from within the chamber containing the product) to escape from the package, as well as allowing atmosphere into the package (i.e., into the chamber which contains the product, or which is designed to contain the product upon the completion of sealing) from outside the package.

When sealing to produce a seal having a discontinuity which serves as a vent, a portion (i.e., segment) of the seal wire is recessed into the seal bar at the location of the vent. The seal wire is recessed about 0.050 inches into the seal bar, i.e., away from the bag to be sealed. The recessed portion of the seal wire is covered with a thin strip of silicone rubber (60 durometer silicone rubber, 1/16 inch thick). The entire seal bar/wire assembly is covered with polytetrafluoroethylene tape having a thickness of about 0.006 inch. Thereafter, when the seal bar is pressed against the film to be sealed, no seal is formed over the recessed portion of the seal wire.

As used herein, the term "barrier", and the phrase "barrier layer", as applied to films and/or film layers, are used with reference to the ability of a film or film layer to serve as a barrier to one or more gases. In the packaging art, oxygen (i.e., gaseous $O_2$) barrier layers have included, for example, hydrolyzed ethylene/vinyl acetate copolymer (designated by the abbreviations "EVOH" and "HEVA", and also referred to as "ethylene/vinyl alcohol copolymer"), polyvinylidene chloride, polyamide, polyester, polyalkylene carbonate, polyacrylonitrile, etc., as known to those of skill in the art.

As used herein, the phrase "outside layer" refers to the outer layer, of a multilayer film packaging a product, which is furthest from the product relative to the other layers of the multilayer film. "Outside layer" also is used with reference to the outermost layer of a plurality of concentrically arranged layers simultaneously coextruded through an annular die. Moreover, an outside layer has an "surface" and an "outside surface," the inside surface being that surface of the outside layer which is adhered to another film layer, and the outside surface of the outside layer being that surface which is not adhered to another film layer.

As used herein, the phrase "directly adhered", as applied to film layers, is defined as adhesion of the subject film layer to the object film layer, without a tie layer, adhesive, or other layer therebetween. In contrast, as used herein, the word "between", as applied to a film layer expressed as being between two other specified layers, includes both direct adherence of the subject layer between to the two other layers it is between, as well as including a lack of direct adherence to either or both of the two other layers the subject layer is between, i.e., one or more additional layers can be imposed between the subject layer and one or more of the layers the subject layer is between.

As used herein, the phrases "seal layer," "sealing layer," "heat seal layer," and "sealant layer," refer to an outer film layer, or layers, involved in the sealing of the film to itself, another film layer of the same or another film, and/or another article which is not a film. It should also be recognized that in general, up to the outer 3 mils of a film can be involved in the sealing of the film to itself or another layer. With respect to packages having only fin-type seals, as opposed to lap-type seals, the phrase "sealant layer" generally refers to the inside film layer of a package, as well as supporting layers within 3 mils of the inside surface of the sealant layer, the inside layer frequently also serving as a food contact layer in the packaging of foods. In general, sealant layers employed in the packaging art have included thermoplastic polymers, such as polyolefin (e.g., linear low density polyethylene, very low density polyethylene, homogeneous polymers such as metallocene catalyzed ethylene/alpha-olefin copolymer, etc.), polyamide, polyester (e.g., polyethylene terephthalate glycol), ethylene/ester copolymer (e.g., ethylene/vinyl acetate copolymer), ionomer, etc.

As used herein, the phrases "heat-shrinkable," "heat-shrink" and the like refer to the tendency of a film, generally an oriented film, to shrink upon the application of heat, i.e., to contract upon being heated, such that the size (area) of the film decreases while the film is in an unrestrained state decreases. Likewise, the tension of a heat-shrinkable film increases upon the application of heat if the film is restrained from shrinking. As a corollary, the phrase "heat-contracted" refers to a heat-shrinkable film, or a portion thereof, which has been exposed to heat such that the film or portion thereof is in a heat-shrunken state, i.e., reduced in size (unrestrained) or under increased tension (restrained). Preferably, the heat shrinkable film has a total free shrink (i.e., machine direction plus transverse direction), as measured by ASTM D 2732, of at least as 5 percent at 185° C., more preferably at least 7 percent, still more preferably, at least 10 percent, and, yet still more preferably, at least 20 percent.

As used herein, the phrase "machine direction", herein abbreviated "MD", refers to a direction "along the length" of the film, i.e., in the direction of the film as the film is formed during extrusion and/or coating. As used herein, the phrase "transverse direction", herein abbreviated "TD", refers to a direction across the film, perpendicular to the machine or longitudinal direction.

As used herein, the phrase "free shrink" refers to the percent dimensional change in a 10 cm×10 cm specimen of film, when shrunk at 185° F., with the quantitative determination being carried out according to ASTM D 2732, as set forth in the 1990 *Annual Book of ASTM Standards,* Vol. 08.02, pp. 368–371, which is hereby incorporated, in its entirety, by reference thereto.

Preferred multilayer film useful in the packaged product and process of the present invention has at least 2 layers (preferably from 2 to 20 layers), and preferably has from 4 to 12 layers; still more preferably, from 4 to 11 layers; and yet still more preferably, from 6 to 10 layers). However, so long as the multilayer film has at least 4 layers, the multilayer film can have any further number of additional layers desired, so long as the film provides the desired properties for the particular packaging operation in which the film is used, e.g. $O_2$-barrier characteristics, free shrink, shrink tension, optics, modulus, seal strength, etc.

The multilayer film used in the present invention can have any total thickness desired, so long as the film provides the desired properties for the particular packaging operation in which the film is used. Preferably, the film has a total thickness of less than about 20 mils, more preferably the film has a total thickness of from about 2 to 20 mils, still more preferably from about 2 to 10 mils, and yet still more preferably, from about 2 to 6 mils.

Optionally, but preferably, the film use in the present invention is irradiated to induce crosslinking. In the irradiation process, the film is subjected to an energetic radiation treatment, such as corona discharge, plasma, flame, ultraviolet, X-ray, gamma ray, beta ray, and high energy electron treatment, which induce cross-linking between molecules of the irradiated material. The irradiation of polymeric films is disclosed in U.S. Pat. No. 4,064,296, to BORNSTEIN, et. al., which is hereby incorporated in its entirety, by reference thereto. BORNSTEIN, et. al. discloses the use of ionizing radiation for crosslinking the polymer present in the film.

To produce crosslinking, a suitable radiation dosage of high energy electrons, preferably using an electron accelerator, with a dosage level being determined by standard dosimetry methods. Other accelerators such as a Van de Graaf generator or resonating transformer may be used. The radiation is not limited to electrons from an accelerator since any ionizing radiation may be used. The ionizing radiation can be used to crosslink the polymers in the film. Preferably, the film is irradiated at a level of from 0.5–15 MR (5–150 kGy), more preferably 1–8 MR (10–80 kGy), still more preferably, about 3 to 5 MR (30–50 kGy). As can be seen from the descriptions of preferred films for use in the present invention, the most preferred amount of radiation is dependent upon the film composition, thickness, etc., and its end use. Chemical crosslinking can also be utilized, together with electronic crosslinking, or in place of electronic crosslinking.

As is known to those of skill in the art, various polymer modifiers may be incorporated for the purpose of improving toughness and/or orientability or extensibility of the film. Other modifiers which may be added include: modifiers which improve low temperature toughness or impact strength, and modifiers which reduce modulus or stiffness. Exemplary modifiers include: styrene-butadiene, styrene-isoprene, and ethylene-propylene.

As stated above, one or more layers in the multilayer film can comprise polystyrene. Polystyrene is relatively brittle and stiff (i.e., high modulus) in comparison with ethylene based polymers, and also has relatively low elongation in comparison with ethylene based polymers. Orientation can be used to improve the toughness of polystyrene. In addition, blending of particulate rubber with polystyrene improves the impact strength of the polystyrene. Such blends are referred to as High Impact Polystyrene (HIPS). Still, HIPS is relatively brittle. It has been found that brittleness can be reduced by blending with the polystyrene styrene-butadiene copolymer and/or styrene-isoprene copolymer. Conventional polystyrene, as well as high impact polystyrene, are available from both The Dow Chemical Company and BASF Corporation.

In the packaging of dry pet food, one of the main concerns is oxidation of the dry food product. Oxidation in pet food comes from the fat added to the pet food, mineral premixes, and flavor additives such as bloodmeal. Oxidation is a concern because animals begin to discriminate against food that has reached a peroxide value of 20 microequivalent/kg. Peroxide value is the pet food industry standard indicator of oxidation. To combat oxidation, pet food manufacturers use chemical and natural antioxidants (food preservatives). Antioxidants allow for the stability of vitamins, minerals, fatty acids and protein, and the reduction of oxidative rancidity, off flavors and off odors. Natural antioxidants are more expensive than chemical antioxidants. Natural antioxidants include tocopherols, acetic acid and citric acid. Chemical antioxidants include ethoxyquin. A long-term study on the side effects of chemical antioxidants are not available. However, by providing packaging which contains a barrier to $O_2$, there can be a reduction in the amount of natural and/or chemical preservatives used in the packaging. In addition, the presence of an $O_2$-barrier lengthens the shelf life of the packaged product.

FIG. 1 illustrates a perspective view of packaged product 20 in accordance with the present invention. Packaged product 20 comprises side-gusseted bag 22 surrounding a granular bulk product, such as dry pet food (not illustrated). Side-gusseted bag 22 has bottom seal 24, bottom edge 26, first side gusset 28, second side gusset (not illustrated), first bag face surface 30, second bag face surface (not illustrated), inside paired top seal 32 having a gap 34 which forms a first vent, outside paired top seal 36 having a gap 38 which forms a second vent, and top edge 40.

Figure 2:
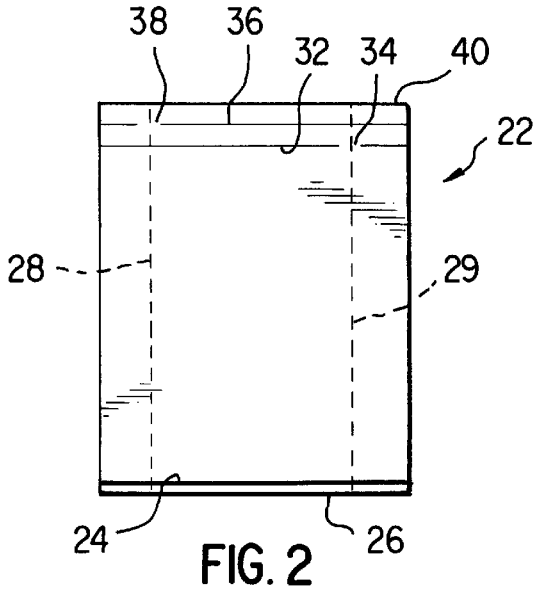
FIG. 2 illustrates a schematic view of a side-gusseted bag having both a bottom seal and a pair of top seals, but without product therein.
Figure 3:
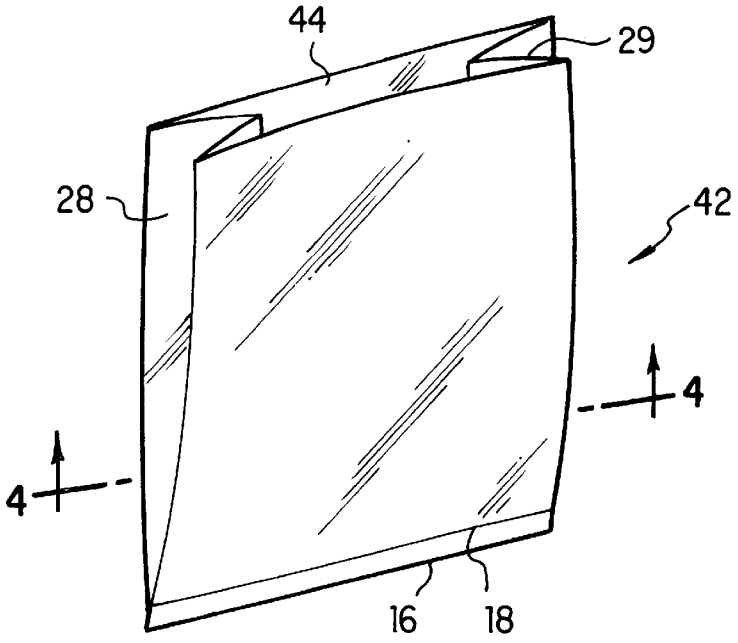
FIG. 3 illustrates a perspective view of a side-gusseted bag before product is added thereto, and before a top seal or seals is made.

The various features illustrated in FIG. 1 are correspondingly numbered in FIG. 2. FIG. 2 contains dotted lines indicating the positions of first side gusset 28 and second side gusset 29. FIG. 3 illustrates side-gusseted bag 42 in lay-flat view, without any product therein, and illustrates open top 44 before the product has been added and the top sealed.

Figure 4A:
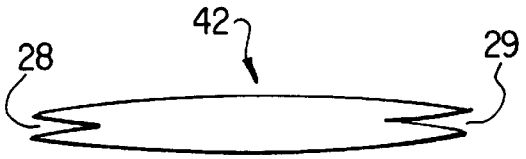
FIG. 4A illustrates a cross-sectional view of a first embodiment of the side-gusseted bag illustrated in FIG. 3.

FIG. 4A illustrates a cross-sectional view of one embodiment of side gusseted bag 42 illustrated in FIG. 3. In FIG. 4A, bag 42 has side gussets 28 and 29, with bag 42 having a seamless tubular cross-section.

Figure 4B:
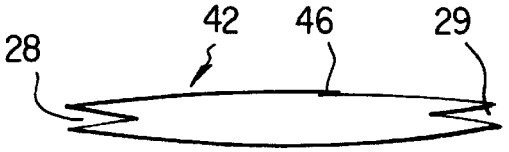
FIG. 4B illustrates a cross-sectional view of a second embodiment of the side-gusseted bag illustrated in FIG. 3.

FIG. 4B illustrates a cross-sectional view of another embodiment of side gusseted bag 42 illustrated in FIG. 3. In FIG. 4B, bag 42 has side gussets 28 and 29, with bag 42 having lap seal 46 running the length of bag 42.

Figure 4C:
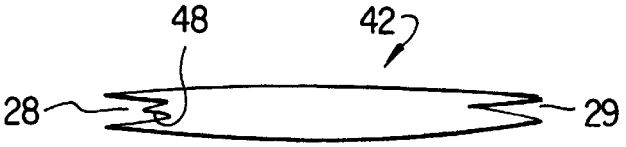
FIG. 4C illustrates a cross-sectional view of a third embodiment of the side-gusseted bag illustrated in FIG. 3.

FIG. 4C illustrates a cross-sectional view of yet another embodiment of side gusseted bag 42 illustrated in FIG. 3. In FIG. 4C, bag 42 has a tubular cross section which includes side gussets 28 and 29, as well as fin seal 48 which runs the length of bag 42.

Figure 5:
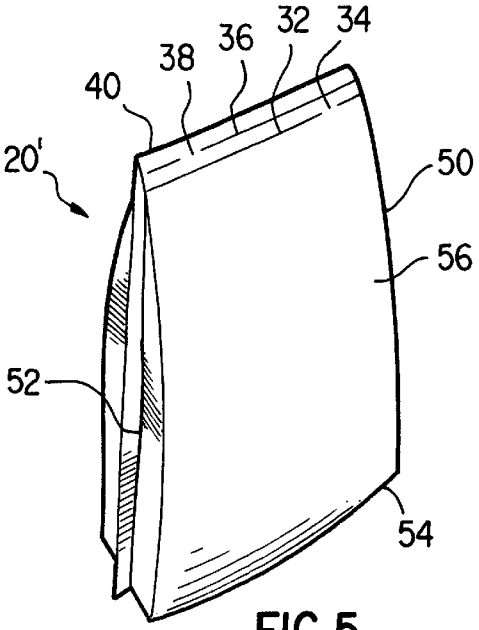
FIG. 5 illustrates a perspective view of a packaged product in accordance with the present invention, utilizing a bottom gusseted bag.

FIG. 5 illustrates a perspective view of an alternative packaged product 20' in accordance with the present invention. Packaged product 20' comprises bottom-gusseted article 50 surrounding a granular bulk product, such as dry pet food (not illustrated). Bottom-gusseted article 50 has first side seal 52, and a second side seal (not illustrated), gusseted bottom 54, first bag face surface 56, second bag face surface (not illustrated), inside paired top seal 32 having a gap 34 which forms a first vent, outside paired top seal 36 having a gap 38 which forms a second vent, and top edge 40.

Figure 7:
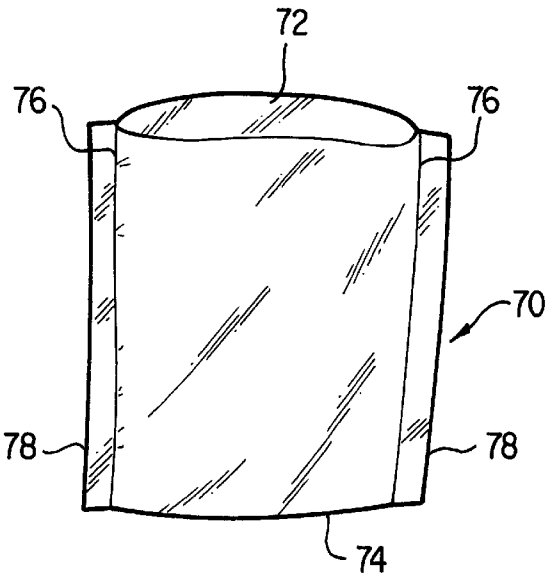
FIG. 7 illustrates a lay-flat view of a non-gusseted side-seal bag suitable for use with the present invention.
Figure 6:
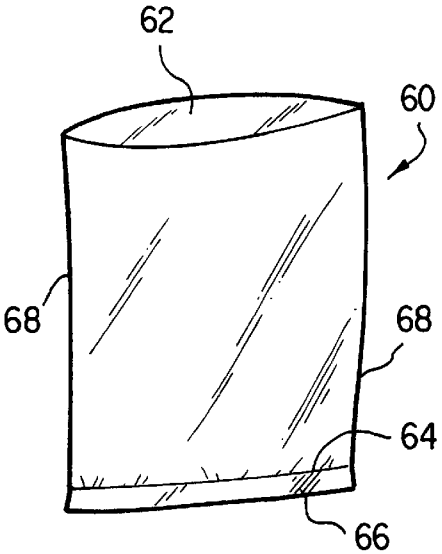
FIG. 6 illustrates a lay-flat view of a non-gusseted end-seal bag suitable for use with the present invention.

FIG. 6 illustrates a schematic view of non-gusseted end-seal bag 60, having open top 62, end seal 64, bottom edge 66, and seamless (folded) side edges 68. FIG. 7 illustrates a schematic view of non-gusseted side-seal bag 70 having open top 72, seamless (folded) bottom edge 74, side seals 76, and side edges 78.

Figure 8:
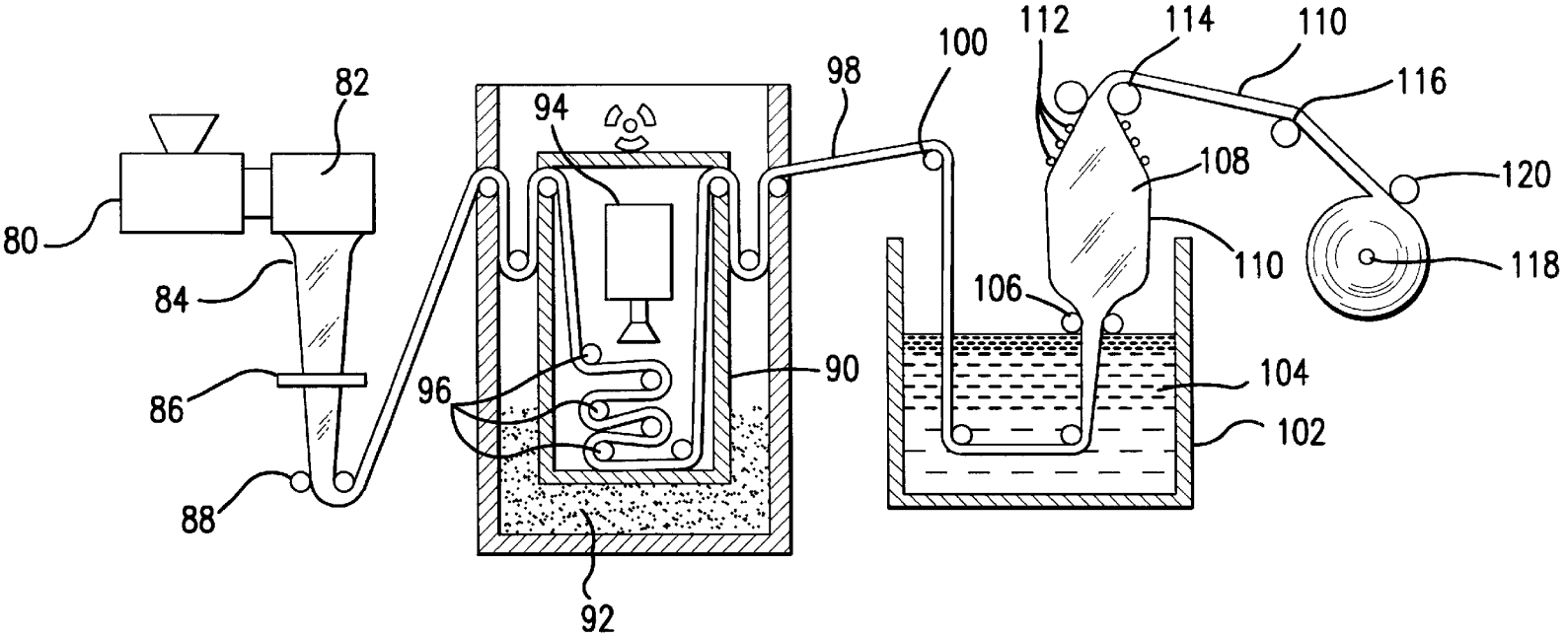
FIG. 8 illustrates a schematic view of a process for making part or all of the multilayer film suitable for use in the article of the present invention.

FIG. 8 illustrates a schematic of a preferred process for producing the multilayer films suitable for use in the article of the present invention. In the process illustrated in FIG. 8, solid polymer beads (not illustrated) are fed to a plurality of extruders 80 (for simplicity, only one extruder is illustrated). Inside extruders 80, the polymer beads are forwarded, melted, and degassed, following which the resulting bubble-free melt is forwarded into die head 82, and extruded through annular die, resulting in tubing 84 which is 5–40 mils thick, more preferably 20–30 mils thick, still more preferably, about 25 mils thick.

After cooling or quenching by water spray from cooling ring 86, tubing 84 is collapsed by pinch rolls 88, and is thereafter fed through irradiation vault 90 surrounded by shielding 92, where tubing 84 is irradiated with high energy electrons (i.e., ionizing radiation) from iron core transformer accelerator 94. Tubing 84 is guided through irradiation vault 90 on rolls 96. Preferably, the irradiation of tubing 84 is at a level of from about 2 to 10 megarads (hereinafter "MR").

After irradiation, irradiated tubing 98 is directed over guide roll 100, after which irradiated tubing 98 passes into hot water bath tank 102 containing water 104. The now collapsed irradiated tubing 98 is submersed in the hot water for a retention time of at least about 5 seconds, i.e., for a time period in order to bring the film up to the desired temperature, following which supplemental heating means (not illustrated) including a plurality of steam rolls around which irradiated tubing 98 is partially wound, and optional hot air blowers, elevate the temperature of irradiated tubing 98 to a desired orientation temperature of from about 240° F.–250° F. Thereafter, irradiated film 98 is directed through nip rolls 106, and bubble 108 is blown, thereby transversely stretching irradiated tubing 98. Furthermore, while being blown, i.e., transversely stretched, irradiated film 98 is drawn (i.e., in the longitudinal direction) between nip rolls 106 and nip rolls 114, as nip rolls 114 have a higher surface speed than the surface speed of nip rolls 106. As a result of the transverse stretching and longitudinal drawing, irradiated, biaxially-oriented, blown tubing film 110 is produced, this blown tubing preferably having been both stretched at a ratio of from about 1:1.5–1:6, and drawn at a ratio of from about 1:1.5–1:6. More preferably, the stretching and drawing are each performed at a ratio of from about 1:2–1:4. The result is a biaxial orientation of from about 1:2.25–1:36, more preferably, 1:4–1:16.

While bubble 108 is maintained between pinch rolls 106 and 114, blown tubing 110 is collapsed by rolls 112, and thereafter conveyed through pinch rolls 114 and across guide roll 116, and then rolled onto wind-up roller 118. Idler roll 120 assures a good wind-up.

Figure 9:
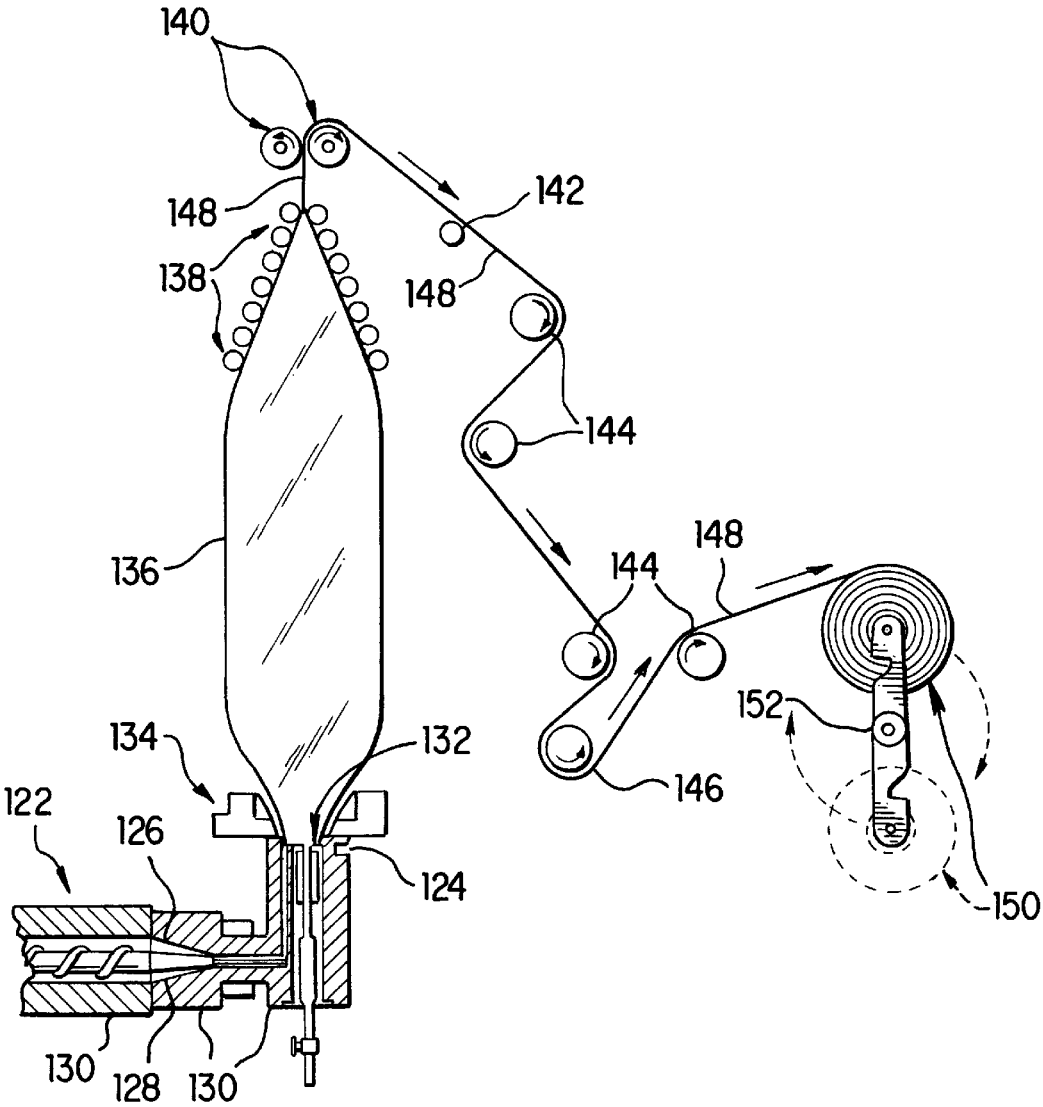
FIG. 9 illustrates a schematic view of another process for making part or all of the multilayer film which is suitable for use in the article of the present invention.

FIG. 9 illustrates a schematic view of another process for making multilayer film for use in the article according to the present invention. Although for the sake of simplicity only one extruder 122 is illustrated in FIG. 7, there are preferably at least 2 extruders, and more preferably, at least three extruders. That is, preferably at least one extruder, and more preferably two extruders, supply molten polymer to coextrusion die. Each of the extruders is supplied with polymer pellets suitable for the formation of the respective layer it is extruding. The extruders subject the polymer pellets to sufficient pressure and heat to melt the polymer and thereby prepare it for extrusion through a die.

Taking extruder 122 as an example, each of the extruders is preferably equipped with a screen pack 126, a breaker plate 128, and a plurality of heaters 130. Each of the coextruded film layers is extruded between mandrel 132 and die 124, and the extrudate is cooled by cool air flowing from air ring 134. The resulting blown bubble is thereafter guided into a collapsed configuration by nip rolls 140, via guide rolls 138. The collapsed tube 148 is optionally passed over treater bar 142, and is thereafter passed over idler rolls 144, and around dancer roll 146 which imparts tension control to collapsed tube 148, after which the collapsed tube is wound into roll 150 via winding mechanism 152.

EXAMPLES

Examples 1 through 6, below, are directed to preferred multilayer films for use in the packaged product according to the present invention.

Example 1 (Laminated Film No. 1)

The preparation of a Laminated Film No. 1 was carried out by casting a solid tape using a process as illustrated in FIG. 8, described above. The tape was irradiated with about 3 megarads of irradiation. The tape was then heated to about 115° C. in an oven and blown into a bubble. The bubble was expanded to about 3.2 times its original dimensions in both the machine (longitudinal) and transverse directions, and then deflated and ply-separated into single-wound film rolls. The final film had a thickness of about 1.0 mil. The first substrate was corona treated and reverse-printed on a flexography press.

A second component film was prepared in a similar manner. The tape outer layer had a major proportion of linear low density polyethylene and a minor portion of an ethylene vinyl acetate. The inner layer was ethylene/vinyl acetate copolymer having a vinyl acetate content of 28 weight percent. In order to prevent the inner layers of tape from self-adhering, the inside surface of the tubular tape was coated powdered cornstarch. The tape was irradiated at 4.0 megarads. The tubular tape was flattened and reheated to 115° C. in an oven, and blown into a bubble. The bubble was expanded to about 3× its original dimensions in both the machine and transverse directions, for a total orientation of 600%. The collapsed and flattened tubing adhered to itself because the expansion of the film reduced the concentration of the corn starch to a level low enough that self-welding would occur. Hence, ply-separation was not required, and a single-wound film roll was produced, this film being the second component film.

The first component film was then laminated to the second component film, using a polyurethane adhesive. During the laminating process, both component films were corona treated in-line. The corona treatment was done to achieve a dyne level above 40. The corona treatment enhanced the bond strength between the laminated films. The resulting Laminated Film No. 1 had a thickness of about 4.3 mil.

Laminated Film No. 1 was then converted into side-gusseted bags and bottom-gusseted bags. A VERTROD® impulse heat sealing machine was used to manually prepare bags. The machine applied an impulse heat seal in the conversion of the film to bags. The bags were filled with various types of hard, dry dog and cat food, with the product being sealed in the bag. Testing of the packaged product was then conducted.

Table 1, below, provides the details of the first and second component films, including the identity of the various polymers present in each of the film layers, the arrangement of each of the film layers, the relative proportions of each of the polymers in each of the film layers, and the thickness of each of the film layers. The bag was formed by sealing the second component film to itself to form the gusseted bag.

TABLE 1

| LAYER COMPOSITION | LAYER THICKNESS (mils) |
|---|---|
| First Component Film | |
| Blend of 50% LLDPE #1, 20% LLDPE #2, 10% EVA #1, and 15% Slip/Antiblock Masterbatch | 0.45 |
| 100% Polymeric Adhesive | 0.12 |
| Blend of 90% EVOH, 10% Nylon 6/Nylon 12 Copolymer | 0.18 |
| 100% Polymeric Adhesive | 0.11 |

TABLE 1-continued

| LAYER COMPOSITION | LAYER THICKNESS (mils) |
|---|---|
| Blend of 50% LLDPE #1, 25% LLDPE #2, 25% EVA #1 | 0.24 |
| Laminating Adhesive Layer between First and Second Component Films | |
| Laminating Adhesive | 0.20 |
| Second Component Film | |
| 87% LLDPE #1, 10% EVA #2, 3% Color Concentrate | 1.29 |
| EVA #3 | 0.46 |
| 87% LLDPE #1, 10% EVA #2, 3% Color Concentrate | 1.26 |

In Table 1

Above:

LLDPE #1 was DOWLEX® 2045 linear low density polyethylene, obtained from Dow Plastics of Freeport, Tex.;

LLDPE #2 was DOWLEX® 2037 linear low density polyethylene, obtained from Dow Plastics of Freeport, Tex.;

EVA #1 was PE 1335 ethylene/vinyl acetate copolymer having a vinyl acetate content about 3.3% by weight, obtained from Rexene;

EVA #2 was ESCORENE® LD 318.92 ethylene vinyl acetate having vinyl acetate content of 9% by weight, obtained from Exxon Chemical Corporation of Houston, Tex.;

EVA #3 was ESCORENE® LD 761.36 ethylene vinyl acetate having vinyl acetate content of 28%, obtained from Exxon Chemical Corporation of Houston, Tex.;

Nylon 6/Nylon 12 Copolymer was GRILLON® CF-6S, obtained from Emser, of Atlanta, Ga.;

EVOH was EVAL® LC-F101A, obtained from Evalca, of Lisle, Ill.

"Polymeric Adhesive" was ADMER® SF 700 A anhydride grafted polyolefins blend, obtained from Mitsui Petrochemicals (America), Ltd., New York, N.Y.;

"Laminating Adhesive" was a solvent-based adhesive of three components by weight; the three components were: 37% ADCOTE® 545-E Adhesive with 60% solids, 3.7% Catalyst F, diisocyanate with 75% solids, and 59.2% ethyl acetate solvent; all three components were obtained from Morton International of Chicago, Ill.; and "Color Concentrate" was 80,274 ACP® Cream Concentrate based in low density polyethylene having 15% pigment, obtained from Teknor Color; and "Slip/Antiblock Masterbatch" was a conventional masterbatch containing silica and waxes, for the purpose of improving the slip and antiblock characteristics of the resulting film.

Example 2 (Laminated Film No. 2)

Laminated Film No. 2 was identical to Laminated Film No. 1, except that EMAC was substituted for the 28% VA EVA in second component film. The EMAC had low odor when compared to EVA and was therefore a better choice for packaging pet food (as pets generally have a keen sense of smell). This second component was crosslinked at about 7 mR (50 kGY). A gusseted bag was made by sealing the second component film to itself.

TABLE 2

| LAYER COMPOSITION | LAYER THICKNESS (mils) |
|---|---|
| First Component Film | |
| Blend of 50% LLDPE #1, 20% LLDPE #2, 10% EVA #1, and 15% Slip/Antiblock Masterbatch | 0.45 |
| 100% Polymeric Adhesive | 0.12 |
| Blend of 90% EVOH, 10% Nylon 6/Nylon 12 Copolymer | 0.18 |
| 100% Polymeric Adhesive | 0.11 |
| Blend of 50% LLDPE #1, 25% LLDPE #2, 25% EVA #1 | 0.24 |
| Laminating Adhesive Layer between First and Second Component Films | |
| Laminating Adhesive | 0.20 |
| Second Component Film | |
| blend of 95.5% LLDPE #1 and 4.5% slip antiblock masterbatch | 1.92 |
| EMAC | 0.675 |
| Blend of 95.5% LLDPE and 4.5% slip antiblock masterbatch | 1.91 |

In Table 2

Above:

EMAC was DS4314-80 ethylene methyl acrylate copolymer having 23% methyl acrylate, obtained from Chevron Corp. of Houston, Tex.

Antiblock Concentrate was 10,183ACP Syloid® concentrate in a LDPE resin, obtained from Teknor Corp. of R.I.

It should be noted that an alternative preferred film similar to Laminated Film Nos. 1 and 2 (above) could have the EVA in the outer film layers replaced with an ultra low density polyethylene, such as ATTANE® ultra low density polyethylene, obtainable from The Dow Chemical Company, identified above.

Example 3 (Laminated Film No. 3)

A first coextruded, oriented component film was laminated to a second coextruded, oriented component film, resulting in a Laminated Film No. 3, having the structure set forth in Table 3, immediately below. A gusseted bag was made by sealing the second component film to itself.

TABLE 3

| LAYER COMPOSITION | LAYER THICKNESS (mils) |
|---|---|
| First Component Film | |
| Blend of 50% LLDPE #1, 20% LLDPE #2, 10% EVA #1, and 15% Slip/Antiblock Masterbatch | 0.45 |
| 100% Polymeric Adhesive | 0.12 |
| Blend of 90% EVOH, 10% Nylon 6/Nylon 12 Copolymer | 0.18 |
| 100% Polymeric Adhesive | 0.11 |
| blend of 50% LLDPE #1, 25% LLDPE #2, 25% EVA #1, | 0.24 |
| Laminating Adhesive between First and Second Component Films | |
| Laminating Adhesive | 0.20 |
| Second Component Film | |
| 87% LLDPE #1, 10% EVA #2, 3% Color Concentrate | 1.91 |
| EVA #3 | 0.73 |
| 87% LLDPE #1, 10% EVA #2, 3% Color Concentrate | 1.89 |

The various resins and other compositions listed in TABLE 3 are as identified below TABLE 1, above.

Example 4 (Laminated Film No. 4)

Laminated Film No. 4 was produced in a manner similar to the production of Laminated Films Nos. 1–3. The first component film had two layers of EVOH. The EVOH layers contained about 20 percent, by weight, Surlyn® AM7927 ionomer resin blended with the EVOH resin, in order to improve orientability of EVOH. The second component film was a reverse-printed film laminated to the first component film. A gusseted bag was made by sealing the first component film to itself.

TABLE 4

| LAYER COMPOSITION | LAYER THICKNESS (mils) |
|---|---|
| First Component Film | |
| blend of 80% LLDPE #A, 20% White Color Concentrate | 1.28 |
| 100% Polymeric Adhesive #A | 0.23 |
| blend of 80% EVOH, 20% N-ionomer | 0.14 |
| 100% Polymeric Adhesive #A | 0.25 |
| 100% EVA | 0.66 |
| 100% Polymeric Adhesive | 0.24 |
| blend of 80% EVOH and 20% N-ionomer | 0.13 |
| 100% Polymeric Adhesive | 0.23 |
| blend of 80% LLDPE #A, 20% White Color Concentrate | 1.29 |
| Laminating Adhesive Layer between First and Second Component Films | |
| Laminating Adhesive | 0.20 |
| Second Component Film | |
| blend of 92% EPC #1 ethylene propylene copolymer #1 and 8% PP #1 | 0.19 |
| 100% LLDPE #1 | 0.60 |
| blend of 92% EPC #1 ethylene propylene copolymer #1 and 8% PP #1 | 0.21 |

LLDPE #A was Elite® 5400 Enhanced Polyethylene ethylene/alpha-olefin copolymer, obtained from The Dow Chemical Company of Freeport, Tex.;

White Color Concentrate was A130195 white color concentrate comprising of 48% LDPE, 48% titanium dioxide and 4% silica, obtained from Plastics Color Chip Inc. , of Asheboro, N.C.;

"Polymeric Adhesive" was Tymor® 1203 anhydride grafted polyolefin blend, obtained from Morton International of Chicago, Ill.

EVOH was EVAL® LC-F101A, obtained from Evalca, of Lisle, Ill.

N- lonomer was Surlyn® AM7927, nylon containing ionomer for blending with EVOH, obtained from DuPont of Wilmington, Del.;

EVA #3 was ESCORENE® LD 761.36 ethylene vinyl acetate having vinyl acetate content of 28%, obtained from Exxon Chemical Corporation of Houston, Tex.;

EPC #1 was ESCORENE® PD-9302 E1 ethylene propylene copolymer having 4.4% random ethylene, obtained from Exxon Chemical Corporation of Houston, Tex.;

PP #1 is ESCORENE® PD 4062.E7 homopolymer polypropylene, obtained from Exxon Chemical Corporation of Houston, Tex.; and "Laminating Adhesive" was a solvent-based adhesive of three components by weight; the three components were: 37% ADCOTE® 545-E Adhesive with 60% solids, 3.7% Catalyst F, diisocyanate with 75% solids, and 59.2% ethyl acetate solvent; all three components were obtained from Morton International of Chicago, Ill.

Example 5 (Laminated Film No. 5)

Laminated Film No. 5 was another preferred film for use in the article according to the present invention. However, Laminated Film No. 5 was made by laminating a first component film (a multilayer film) to a second component film (a monolayer film) which contained only high density polyethylene (HDPE). The first component film was prepared by a process in accordance with FIG. 8, discussed above. The second component film was prepared by a process in accordance with FIG. 9, also discussed above. The resulting Laminated Film No. 5 had a total of 5 layers (including one layer of laminating adhesive). Laminated Film No. 5 exhibited high stiffness (i.e., high modulus) and outstanding tear resistance, together with high gloss and good printability. Laminated Film No. 5 was especially advantageous for providing a gusseted bag having excellent self-supporting characteristics. The gusseted bag was formed by sealing the first component film to itself Laminated Film No. 5 had the structure set forth in Table 5, below.

TABLE 5

| LAYER COMPOSITION | LAYER THICKNESS (mils) |
|---|---|
| First Component Film | |
| 87% LLDPE #1, 10% EVA #2, 3% Color Concentrate | 1.29 |
| EVA #3 | 0.46 |
| 87% LLDPE #1, 10% EVA #2, 3% Color Concentrate | 1.26 |
| Laminating Adhesive between First and Second Component Films | |
| Laminating Adhesive | 0.20 |
| Second Component Film | |
| blend of 60% HDPE and 30% White Concentrate | 2.98 |

wherein;

HDPE was Hid9659 high density polyethylene, obtained from Chevron Chemicals of Houston, Tex.; and White Concentrate was A130175 white color concentrate comprising of 48% LDPE, 48% titanium dioxide and 4% silica, obtained from Plastics Color Chip, Inc.

Example 6 (Laminated Film No. 6)

Laminated Film No. 6 was another preferred film for use in the article according to the present invention. Laminated Film No. 6 was made by laminating a first component film, which was a multilayer film, to a second component film, which was a monolayer film containing high density polyethylene (HDPE). Laminated film No. 6 had a total of 5 layers (including one layer of laminating adhesive), exhibited high stiffness (i.e., high modulus), outstanding tear resistance, high gloss, and good printability. Laminated Film No. 6 was especially advantageous for providing a gusseted bag having excellent self-supporting characteristics.

The gusseted bag was made by sealing the second component film to itself. Laminated Film No. 6 had the structure set forth in Table 6, below.

TABLE 6

| LAYER COMPOSITION | LAYER THICKNESS (mils) |
|---|---|
| First Component Film | |
| blend of 50% LLDPE #1, 20% LLDPE #2, 10% EVA #1, and 15% Slip/Antiblock Masterbatch | 0.45 |
| 100% Polymeric Adhesive | 0.12 |
| blend of 90% EVOH, 10% Nylon 6/Nylon 12 Copolymer | 0.18 |
| 100% Polymeric Adhesive | 0.11 |
| blend of 50% LLDPE #1, 25% LLDPE #2, 25% EVA #1, | 0.24 |
| Laminating Adhesive between First and Second Component Films | |
| Laminating Adhesive | 0.20 |
| Second Substrate | |
| blend of 60% HDPE and 30% White Concentrate | 2.98 |

The various resins and other compositions listed in Table 6 are as identified above in Examples 1–5. Laminated Film No. 6 had a tear strength of about 550 grams.

In the laminated films above which are used to make a gusseted bag for use in accordance with the present invention, the layer sealed to itself to form the gusseted bag preferably is a layer which does not comprise the slip agent. It has been found that if the layer containing the slip agent is sealed to itself, the resulting seal has a significantly lower seal strength than if a layer free of slip agent is sealed to itself. Since Laminated Films Nos. 1, 2, and 3 had slip agent on one of the outer surfaces, but not on the other outer surface, the seals made were fin seals, as opposed to lap seals.

Surprisingly, there is evidence to support the discovery that dogs prefer dry, granular dog food which has been packaged in a vented barrier bag. That is, surprisingly dogs prefer this food to food which is otherwise identical but which has been packaged in an unvented barrier bag. Whether other animals show a similar preference is yet unknown.

Although the present invention has been described in connection with the preferred embodiments, it is to be understood that modifications and variations may be utilized without departing from the principles and scope of the invention, as those skilled in the art will readily understand. Accordingly, such modifications may be practiced within the scope of the following claims.

What is claimed is:

1. A packaged product comprising a packaging article comprising a flexible non-perforated packaging film and a product surrounded by the packaging article, wherein the packaging article comprises a first seal extending from a first side edge of the article to a second side edge of the article and a second seal extending from the first side edge of the article to the second side edge of the article, the first seal being paired with the second seal and being inward of the second seal, with the first seal being separated from the second seal by a distance of from about ½ to 4 inches, with both the first and second seals being of the film to itself or another non-perforated film, with a discontinuity in the first seal providing a first vent, and a discontinuity in the second seal providing a second vent, with the discontinuity in the first seal being in a region inward of the first and second side edges of the article, and the discontinuity in the second seal also being in a region inward of the first and second side edges of the article, with the discontinuity in the first seal being offset from the discontinuity in the second seal, to provide a tortuous path into and out of the article.

2. The packaged product according to claim 1, wherein the first seal is a heat seal and the second seal is a heat seal.

3. The packaged product according to claim 1, wherein the first vent has a length of from about ⅛ inch to 3 inches, and the second vent has a length of from about ⅛ inch to 3 inches.

4. The packaged product according to claim 1, wherein the first vent is offset from the second vent by a distance of at least about 1 inch.

5. The packaged product according to claim 1, wherein the paired seals are separated by a distance of from about ¾ to 2 inches.

6. The packaged product according to claim 1, wherein the paired seals are linear and parallel to one another.

7. The packaged product according to claim 1, wherein the product has a weight of at least 5 kilograms.

8. The packaged product according to claim 1, wherein the product comprises granular, dry edible particulates.

9. The packaged product according to claim 8, wherein the granular, dry edible particulates comprise pet food.

10. The packaged product according to claim 1, wherein the packaging article is a member selected from the group consisting of an end-seal bag and a side-seal bag.

11. The packaged product according to claim 10, wherein the packaging article comprises side gussets.

12. The packaged product according to claim 10, wherein the packaging article comprises a bottom gusset.

13. The packaged product according to claim 1, wherein the first seal is a seal of the film to itself, and the second seal is a seal of the film to itself.

14. The packaged product according to claim 13, wherein the seal is a seal of an inside layer of the film to itself.

15. The packaged product according to claim 1, wherein the packaging article comprises a multilayer film having:

(A) a first film layer which is an inside film layer comprising at least one member selected from the group consisting of ethylene/alpha-olefin copolymer and polystyrene;

(B) a second film layer comprising at least one member selected from the group consisting of ethylene/unsaturated ester copolymer, anhydride-modified ethylene/alpha-olefin copolymer, anhydride-modified ethylene/ester copolymer, acid-modified ethylene/alpha-olefin copolymer, acid-modified ethylene/acid copolymer, and polystyrene;

(C) a third film layer comprising at least one member selected from the group consisting of ethylene/alpha-olefin copolymer and polystyrene;

(D) a fourth film layer which comprises at least one member selected from the group consisting of ethylene homopolymer, ethylene/alpha-olefin copolymer, ethylene/vinyl alcohol copolymer, polyvinylidene chloride, polyamide, polyester, polyalkylene carbonate, polyacrylonitrile, and ethylene/unsaturated ester copolymer; and wherein at least 85 percent of the film, based on total film volume, consists of at least on member selected from the group consisting of polyolefin homopolymer, polyolefin copolymer, ethylene/ester copolymer, polystyrene, styrene/butadiene copolymer, EVOH, PVDC, and polyacrylonitirile, and wherein the film has a total thickness of at least 2 mils, and an impact strength of at least about 1.5 ft-lbs, and a total free shrink, at 180° F., of less than 80 percent.

16. The packaged product according to claim 15, wherein the multilayer film comprises an $O_2$-barrier layer comprising at least one member selected from the group consisting of ethylene/vinyl alcohol copolymer, polyvinylidene chloride, and polyamide.

17. The packaged product according to claim 15, wherein the second layer is between the first layer and the third layer, and the third layer is between the second layer and the fourth layer.

18. The packaged product according to claim 1, wherein the paired seals are separated by a distance of from about 1 to 1½ inches.

19. The packaged product according to claim 1, wherein the entire first vent is offset from the entire second vent by a distance of at least 1 inch.

20. The packaged product according to claim 1, wherein the entire first vent is offset from the entire second vent by a distance of from 3 to 15 inches.

21. The packaged product according to claim 1, wherein the entire first vent is offset from the entire second vent by a distance of from 5 to 15 inches.

22. The packaged product according to claim 1, wherein the first seal has only one discontinuity and the second seal has only one discontinuity.

23. The packaged product according to claim 1, wherein the first seal is along a straight line and the second seal is along a straight line.

24. The packaged product according to claim 23, wherein the first seal is parallel to the second seal.

25. The packaged product according to claim 24, wherein the first seal is a heat seal and the second seal is a heat seal.

26. The packaged product according to claim 25, wherein the first seal is straight and of uniform width, and the second seal is straight and of uniform width.

27. The packaged product according to claim 1, wherein the vents are in a region of the article in which films are not overlapping.

* * * * *